US007225606B2

(12) United States Patent
Hoersch

(10) Patent No.: US 7,225,606 B2
(45) Date of Patent: Jun. 5, 2007

(54) ROTOR CUP FOR AN OPEN-END SPINNING DEVICE

(75) Inventor: Paul Hoersch, Suessen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 11/305,251

(22) Filed: Dec. 19, 2005

(65) Prior Publication Data

US 2006/0130453 A1 Jun. 22, 2006

(30) Foreign Application Priority Data

Dec. 20, 2004 (DE) ..... 10 2004 062 794

(51) Int. Cl.
*D01H 4/10* (2006.01)

(52) U.S. Cl. ..... 57/404

(58) Field of Classification Search ..... 57/404–417
See application file for complete search history.

(56) References Cited

U.S. PATENT DOCUMENTS

| | | | | |
|---|---|---|---|---|
| 3,439,487 A | | 4/1969 | Landwehrkamp et al. | |
| 4,319,449 A | * | 3/1982 | Hofmann | 57/404 |
| 4,339,911 A | * | 7/1982 | Hofmann | 57/416 |
| 4,663,930 A | * | 5/1987 | Landwehrkamp | 57/416 |

FOREIGN PATENT DOCUMENTS

| | | |
|---|---|---|
| DE | 1560307 | 4/1971 |
| DE | 2551045 A1 | 5/1976 |

* cited by examiner

*Primary Examiner*—Shaun R. Hurley
(74) *Attorney, Agent, or Firm*—Crowell & Moring LLP

(57) ABSTRACT

A rotor cup for an open-end spinning device comprises a supporting base body which is provided with an insert. The insert comprises the fiber guiding surfaces, namely a fiber sliding surface and a fiber collecting groove. The insert is centered radially in the base body and is supported axially with a stopping face at the base body and crimped therein.

16 Claims, 2 Drawing Sheets

16
7
14
13
15
4

A
17
B
19
16
12
3
18
13

ROTOR CUP FOR AN OPEN-END SPINNING DEVICE

BACKGROUND AND SUMMARY OF THE INVENTION

This application claims the priority of German Application No. 10 2004 062 794.0 filed Dec. 20, 2004, the disclosure of which is expressly incorporated by reference herein.

The present invention relates to a rotor cup for an open-end spinning device, which comprises a supporting base body, which is provided with an insert comprising a fiber guiding surface and a fiber collecting groove, which insert is radially centered in the base body and axially supported thereon with a stopping face.

In the case of a rotor cup of this type (German published patent 15 60 307, corresponding U.S. Pat. No. 3,439,487) the two-part rotor cup comprises a base body having a high strength and an insert which comprises the fiber guiding surfaces. This insert is inserted into the inside of the base body in the form of a pot-shaped lining, said insert comprising the fiber sliding surface as well as the fiber collecting groove, both of which are designed to achieve the best spinning properties. Due to the present standard high rotational speeds of the rotor cup, the base body is subject to very high centrifugal forces, which results in the walls of the base body which hold the insert expanding. There is a risk that the insert becomes loose thus rendering the rotor cup unusable.

In the case of a similar two-part rotor cup of this type (German published patent application 2551 045) a base body is provided which is suitable for high rotational speeds, said base body being provided with a wear-resistant, pot-shaped insert made from sintered ceramic which comprises the fiber guiding surfaces. Here the insert can be bonded or pressed into the base body. Apart from the aim of achieving good wear protection, nothing further is disclosed about this rotor cup.

It is an object of the present invention to design a rotor cup of the above mentioned type in such a way that the centrifugal forces occuring at high speeds are not damaging. It should be hereby possible to produce one and the same base body and to equip it with various inserts according to the desired application.

This object has been achieved in accordance with preferred embodiments of the present invention in that the insert is crimped into the base body.

Because the edge of the base body is crimped over the insert according to certain preferred embodiments of the invention, the insert is affixed in radial and in axial direction, which ensures that the insert cannot become loose even at high speeds. The same base body having constant dimensions can be used for the entire production, into which base body a variety of inserts having different functions can be inserted. This can involve varying diameters, various forms of the fiber collecting groove or different materials of the fiber guiding surfaces. The base body can be made of steel or aluminum, while the insert can be made of steel, ceramic or sintered material as desired according to certain preferred embodiments of the present invention. In addition, the fiber guiding surfaces of the insert can be coated according to the desired spinning conditions or the service life without the base body having to be treated in the same way according to certain preferred embodiments of the present invention.

Preferably the insert is supported in the base body in the area of the fiber collecting groove only according to certain preferred embodiments of the present invention. This results in a significant saving in material in relation to the base body in comparison to the above mentioned prior art.

In certain preferred embodiments of present invention, the insert is provided on its outer side facing away from the stopping face with a ring groove for the purposes of crimping.

During crimping, the stopping face is pressed tightly on the base body and radially secured due to the ring groove. The insert itself is designed essentially as a conical ring, corresponding to the slope of the fiber sliding surface, whereby the inside of the rotor cup has its biggest diameter at the fiber collecting groove according to certain preferred embodiments of the present invention.

The present invention also relates to a process for producing a rotor cup of the above mentioned type. A semi-finished part made of plastically formable material and having a pot-shaped take-up part having an open front face is produced for the formation of a base body, in which semi-finished part a finished insert is placed, which subsequently is secured by means of crimping over a front edge of the take-up part, which subsequently forms the base body, according to certain preferred embodiments of the present invention.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
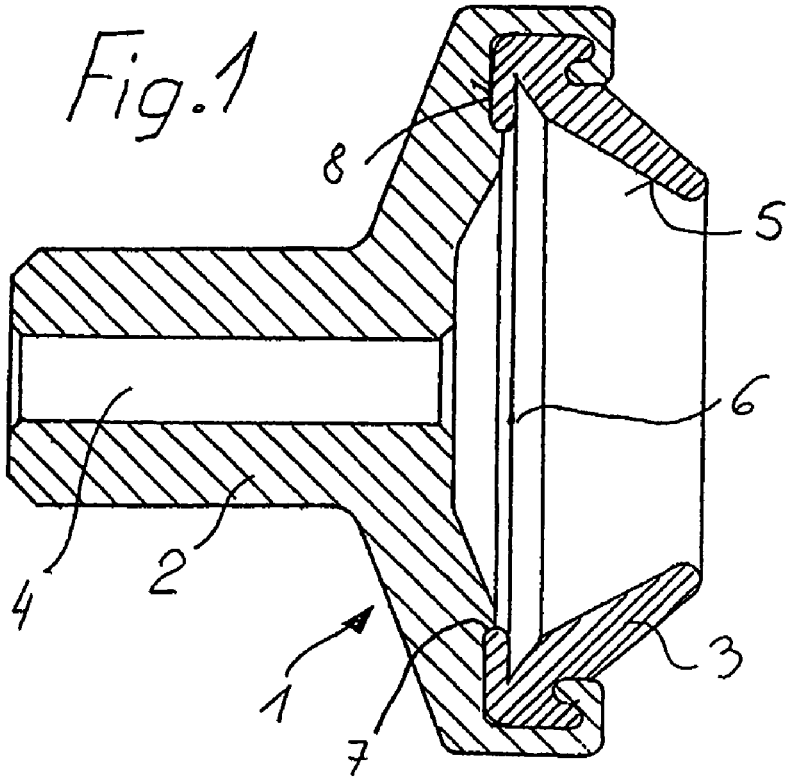
FIG. 1 shows a rotor cup of the present invention in axial section and greatly enlarged.
Figure 2:
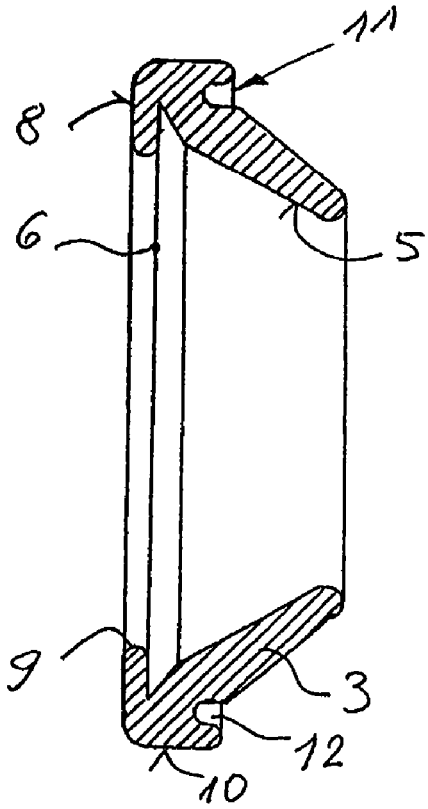
FIG. 2 shows the insert in axial section as shown in the rotor cup in FIG. 1.

The rotor cup 1 for an open-end spinning device shown in FIG. 1 comprises a supporting base body 2 and an insert 3 affixed therein. The base body 2 is provided with an axial bore hole 4 for the purpose of taking up a rotor shaft (not shown), which can be supported and driven in the known way. The insert 3 comprises a fiber sliding surface 5, which widens conically to form a fiber collecting groove 6, in which the inside of the rotor cup 1 has its largest diameter. The functions of the fiber sliding surface 5 and the fiber collecting groove 6 are known to those skilled in the art and do not need to be described here in detail.

The base body 2 is provided with a shoulder 7 for the radial centering of the insert 3. The latter insert 3 comprises a stopping face 8, on which it is axially supported on a corresponding surface of the base body 2.

The insert 3 is supported only in the area of the fiber collecting groove 6 in the base body 2 and is crimped therein. Because of the crimping process, the insert 3 is securely affixed both axially and radially, which renders the rotor cup 1 unsusceptible to loosening by centrifugal forces at high rotational speeds.

In the case of the rotor cup 1 according to preferred embodiments of the present invention, it is possible to produce a large number of identical base bodies 2, into which differently designed inserts 3 can be crimped as required. The design, diameter, material or coating for the fiber collecting groove 6 and the fiber sliding surface 5 can be chosen and adapted to suit the particular area of application, in particular the spinning conditions or the fiber materials.

All these possible inserts 3, which can all vary with regard to the fiber sliding surface 5 and/or the fiber collecting groove 6, have the same cylindrical outer contour 10 and the same centering surface 9 for the shoulder 7 of the base body 2, according to preferred embodiments of the invention. As can be seen, the insert 3 is provided on its outer surface 11 facing away from the stopping face 8 with a ring groove 12 for the purposes of crimping. This ring groove 12, in combination with the stopping face 8 and the outer contour 10, serves to affix the insert 3 in the base body 2, whereby widening caused by centrifugal forces during operation is effectively prevented.

Figure 3:
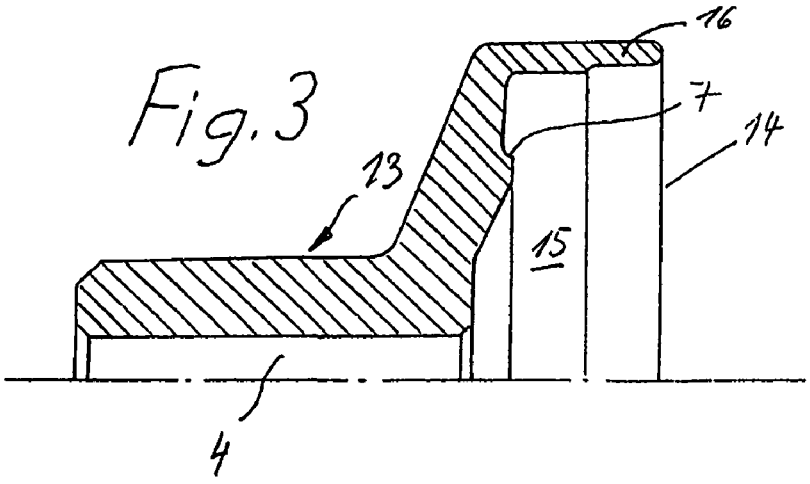
FIG. 3 shows the semi-finished part in axial section, from which the base body of the rotor cup is formed.

The semi-finished part 13, from which the base body 2 is formed, is shown in FIG. 3. The axial borehole 4 and the shoulder 7 are again present.

The semi-finished part 13 is produced from a plastically formable material, preferably a steel or aluminum alloy, in such a way that a pot-shaped take-up part 15, having an open face 14 for the insert 3, is created. The take-up part 15 comprises a front edge 16 on its outer wall, which is later crimped over.

A finished insert 3 having the desired design is inserted into the take-up part 15 of the semi-finished part 13 shown in FIG. 3. The insert 3 is subsequently affixed in the base body 2 by means of crimping over the front edge 16 of the take-up part 15.

Figure 4:
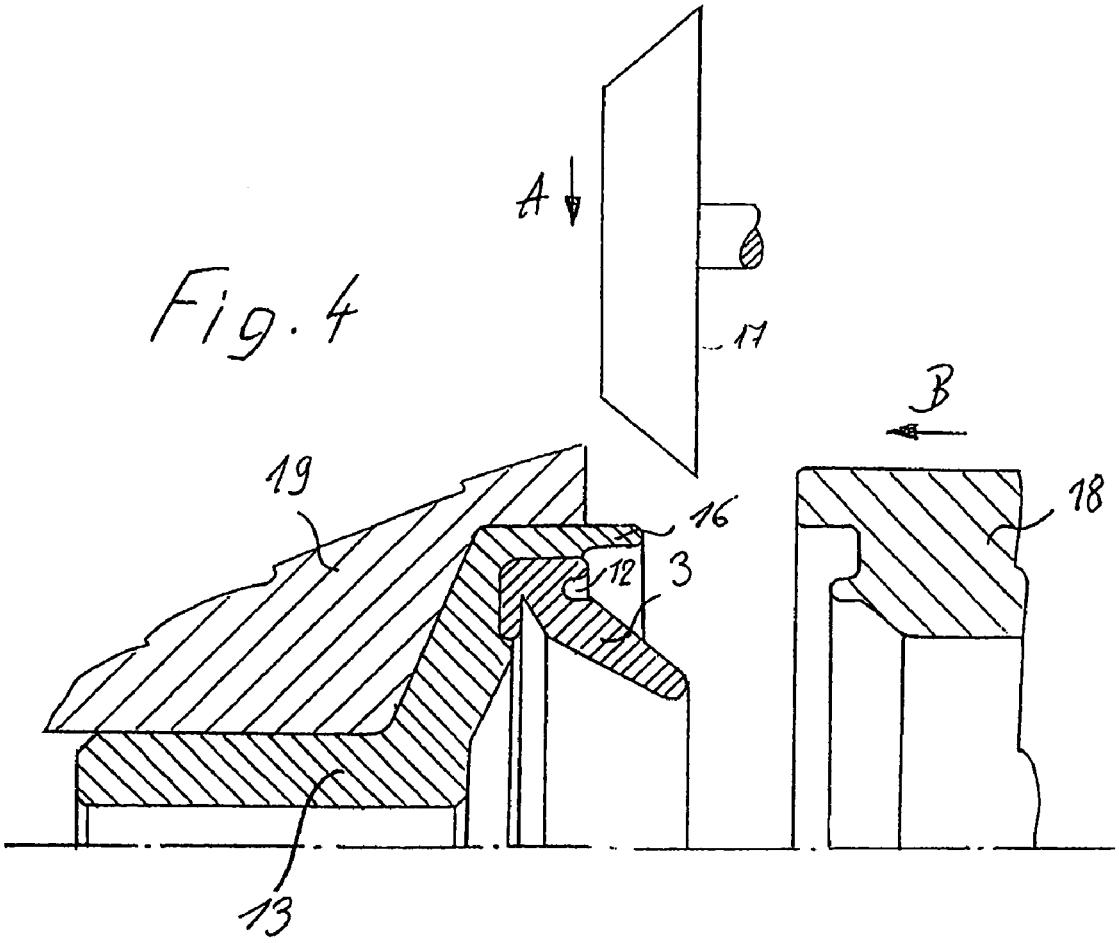
FIG. 4 shows in schematic depiction the process of the crimping of the base body of the rotor cup over the insert, according to certain preferred embodiments of the invention.

This is schematically shown in FIG. 4, where a crimping roller 17 in radial direction and a crimping ring 18 in axial direction are positioned according to the arrow directions A and B with respect to the not yet crimped front edge 16. The semi-finished part 13 is hereby radially and axially supported with positive fit in a take-up 19. It can be provided if required that the semi-finished part 13 is imparted a rotational movement during the crimping process.

The particular methods of the crimping process are not significant for the present invention, so that FIG. 4 is simply to be seen as a schematic example. In the variation shown, it is optionally provided that the end piece of the front edge 16 reaches into the ring groove 12 during the crimping process.

After the insert 3 has been crimped into the base body 2, the rotor cup 1 which arises therefrom is then provided in the known way with its rotor shaft. Subsequently a balancing process can be carried out in the known way.

A particular advantage of the rotor cup 1 according to the present invention is that semi-finished parts 13, which are all identical with regard to their dimensions, can be selectively combined with differently designed inserts 3 as required. Thus the different forms are limited exclusively to the inserts 3, which comprise the fiber sliding surface 5 and the fiber collecting groove 6.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Rotor cup for an open-end spinning device, comprising:

a supporting base body having a plastically deformable front edge, which is provided with an insert comprising a fiber guiding surface and a fiber collecting groove, which insert is radially centered in the base body and axially supported thereon with a stopping face, wherein a crimped connection is formed by plastically deforming the front edge of the base body around an outer contour edge of the insert.

2. A rotor cup according to claim 1, wherein the insert is held in the base body in the area of the fiber collecting groove only.

3. A rotor cup according to claim 1, wherein the insert is provided on its outer side facing away from the stopping face with a ring groove for the purposes of crimping.

4. A rotor cup according to claim 2, wherein the insert is provided on its outer side facing away from the stopping face with a ring groove for the purposes of crimping.

5. Rotor cup according to claim 1, wherein the insert is essentially designed as a conical-shaped ring.

6. Rotor cup according to claim 2, wherein the insert is essentially designed as a conical-shaped ring.

7. Rotor cup according to claim 3, wherein the insert is essentially designed as a conical-shaped ring.

8. Rotor cup according to claim 4, wherein the insert is essentially designed as a conical-shaped ring.

9. A process for producing a rotor cup for an open-end spinning device, comprising a supporting base body, which is provided with an insert comprising a fiber guiding surface and a fiber collecting groove, which insert is radially centered in the base body, and axially supported thereon with a stopping face, said process comprising:

providing a semi-finished part from plastically formable material, preceding a base body to be formed, and having a pot-shaped take-up portion having an open face, inserting a finished insert into the semi-finished part, and subsequently affixing the insert in the semi-finished part by crimping over a front edge of the take-up portion thereby forming the rotor cup.

10. A process according to claim 9, wherein regarding the dimensions, identically designed semi-finished parts can be combined with differently designed inserts as required.

11. A process according to claim 8, wherein the insert is held in the base body in the area of the fiber collecting groove only.

12. A process according to claim 8, wherein the insert is provided on its outer side facing away from the stopping face with a ring groove for the purposes of crimping.

13. A process according to claim 9, wherein the insert is provided on its outer side facing away from the stopping face with a ring groove for the purposes of crimping.

14. A process according to claim 9, wherein the semi-finished part is produced from steel or aluminum alloy.

15. A process according to claim 9, wherein the insert comprises sintered-ceramic material.

16. A process according to claim 14, wherein the insert comprises sintered-ceramic material.

* * * * *